US005945619A

United States Patent [19]

Tamura

[11] Patent Number: 5,945,619

[45] Date of Patent: Aug. 31, 1999

[54] ASYNCHRONOUS COMPUTATION OF TONE PARAMETER WITH SUBSEQUENT SYNCHRONOUS SYNTHESIS OF TONE WAVEFORM

[75] Inventor: Motoichi Tamura, Hamamatsu, Japan

[73] Assignee: Yamaha Corporation, Hamamatsu, Japan

[21] Appl. No.: 09/174,844

[22] Filed: Oct. 19, 1998

[30] Foreign Application Priority Data

Oct. 21, 1997 [JP] Japan ..... 9-305022

[51] Int. Cl.[6] ..... G10H 1/26; G10H 7/00

[52] U.S. Cl. ..... 84/604; 84/609

[58] Field of Search ..... 84/601–607, 609–620, 84/622–633

[56] References Cited

U.S. PATENT DOCUMENTS 5,596,159 1/1997 O'Connell .

OTHER PUBLICATIONS

Hal Chamberlin, "Musical Applications of Microprocessors", 2nd Ed., Hayden Books, 1987, pp. 639–774.

*Primary Examiner*—Stanley J. Witkowski

*Attorney, Agent, or Firm*—Graham & James LLP

[57] ABSTRACT

An electronic musical apparatus utilizes a central processing unit for working various modules to generate music tones, while controlling a work load of the central processing unit. The apparatus is composed of a player module, a driver module, a sound source module, and a timing module. The player module provides a sequence of event data indicating an event of a music tone and timing data indicating an occurrence time of the event. The driver module is intermittently triggered to process the event data to create control parameters reserved for use in generation of the music tone corresponding to the event data. The sound source module is routinely triggered to load therein the reserved control parameters for generating the music tone according to the timing data. The timing module issues a synchronous trigger signal effective to routinely trigger the sound source module, and issues an asynchronous trigger signal independently of the timing data for intermittently triggering the driver module so as to avoid concentration of the work load of the central processing unit.

22 Claims, 10 Drawing Sheets

ASYNCHRONOUS COMPUTATION OF TONE PARAMETER WITH SUBSEQUENT SYNCHRONOUS SYNTHESIS OF TONE WAVEFORM

BACKGROUND OF THE INVENTION

The present invention relates to a method of generating a waveform of a music, in which a microprocessor is utilized to execute a music tone generation program.

A music tone generating apparatus of the prior art is typically constituted of a player module (an automatic musical performance program) sequentially providing a MIDI (Musical Instrument Digital Interface) event in a timing as indicated by a music score, a driver module generating a control parameter in response to the MIDI event every time the MIDI event is a provided, and a sound source module or engine generating a music tone waveform based on the generated control parameter. Moreover, the driver module of the sound source module (hereafter, sound source driver) executes various tasks such as channel assignment and conversion of the control parameter in response to the entered MIDI event. Furthermore, the sound source driver loads the control parameter and issues an activating command (Note-On message) to a channel assigned to the relevant event. The sound source module is constituted of a hardware device such as a dedicated LSI (a large scale integrated circuit) and a DSP (a digital signal processor). Otherwise, the sound source module may be constituted of a software sound source, in which a CPU executes a program describing a music tone generation processing procedure.

As described above, the music tone generating apparatus is constituted of the player, the sound source driver and the sound source engine. A work load of these modules is not constant, but rather it is general to fluctuate greatly. For example, when many of the MIDI events occur in a short period, the work load to be processed by the player and the sound source driver becomes high. Especially, when many of the Note-On events are present concurrently, the work load to be processed by the sound source driver becomes high volume. In case of the Note-On event, the sound source driver searches a free channel to perform a channel assignment such that the searched free channel is assigned to the Note-On event for generating a music tone corresponding to the Note-On event. The search processing and truncate processing which are performed at this time are time-consuming and are large in work load. Furthermore, in case of the Note-On event, a tone color setting process is also performed in response to a key touch. Thus, when the Note-On events are present concurrently, the work load of the sound source driver processing becomes high volume. Moreover, in case that the sound source engine is constituted of a software module, when the number of concurrent music tones is great, the work load of the sound source engine becomes high.

The processing in the player, sound source driver and sound source module are described specifically by a timing chart of FIG. 9. The timing chart shows process timing of a conventional music tone generating apparatus. MIDI inputs M1 to M4 denote successive MIDI events, and are input at the timing shown by the arrows of downward direction, respectively. For example, these MIDI events are provided when the player or sequencer reads out a MIDI file to reproduce music notes at the timing designated in accordance with a music score contained in the MIDI file. Every time the MIDI input M1 to M4 is received, a high priority interrupt is generated to start MIDI processing. By the started MIDI processing, the MIDI input M1 to M4 is sequentially stored into an input buffer together with time data received.

In the sound source driver processing "a" and "b", the sound source driver receives the MIDI events stored in the input buffer to perform the channel assignment and generation of control parameters in response to the MIDI events. At this point, the control parameters generated are stored into a control parameter buffer.

Moreover, waveform generation processing A, B, . . . , E is started at a certain period of time t1, t2, . . . , t5, . . . , and the waveform generation processing is executed for generating a waveform of music tones by the sound source engine. Samples of the music tone waveform are successively generated on the basis of the control parameters read out from the control parameter buffer and loaded into the sound source engine.

In the waveform generation processing, a certain time period is defined as one frame. For example, in this waveform generation processing, drive of the sound source engine by the control parameter generated in the frame from the timing t1 to t2 is executed in the subsequent frame from the timing t2 to t3. In this subsequent frame, the music tone waveform responsive to the control parameter is generated in the form of a sequence of sample values arranged throughout one frame period. The music tone waveforms concurrently generated at active channels of the sound source engine are accumulated with one another. One frame of the music tone waveforms obtained consequently are reserved for reproduction by a reproduction device being constituted of a DAC (a digital to analogue converter) or the like.

Furthermore, in the waveform generation processing, the reproduction device reads out the music tone waveform a sample by sample from an output buffer every sampling period. For example, samples of the music tone waveform generated in the frame from the timing t2 to t3 are reproduced in the subsequent frame from the timing t3 to t4. Therefore, a delay time $\Delta t$ from input of the MIDI event till actual sounding of the MIDI event becomes two frames at the shortest. Generation of the music tone waveform to be reproduced in the subsequent frame should be completed within the period of the current frame. Generally, one frame is defined as a time period of several milliseconds.

In general, the sound source driver is realized by allowing a CPU to execute the sound source driver program. The sound source driver processing is commenced basically at occurrence of music events such as Note-On event, Note-Off event and program change event. Therefore, as shown in FIG. 9, when a plurality of events M1 to M3 are entered substantially at a simultaneous time, the load of the sound source driver is increased suddenly. Therefore, upon concentrating of the events, the large load is imposed on the CPU executing the sound source driver processing. At the same time, it can be caused risks that an automatic musical performance program, a game program, an image processing program or the like which the CPU executes becomes impossible to run. Especially, when the sound source engine is constituted of the software and the number of music tones to be computed and synthesized by the software sound source are great, the load of the software sound source becomes high volume due to increase of the music tone waveforms to be generated. Due to a high number of concurrent music tones, the music events occur quite frequently, whereby the load to be processed by the sound source driver and the player becomes high volume inevitably. Therefore, there has been the risk that when the number of music tones to be computed in the software sound source is present in high volume, associated processing to generate the music tones is also increased. Such a situation actually reduces the computable number of music tones.

Usually, the software sound source has a capacity to sound thirty-two number of music tones simultaneously. Stated otherwise, the software sound source engine has the thirty-two number of channels. However, when the Note-On events concentrate at a short period, the major portion of the computation ability of the CPU comes to be consumed for the Note-On event processing being executed by the sound source driver. As a result, the computation ability of the CPU assigned to the software sound source is reduced, whereby the music tone waveforms of the entire thirty-two notes cannot be generated.

There has been a method for solving this problem. That is, when there is a margin in the work load of the CPU, the waveform of the music tone is generated in advance before the sound timing on the basis of the control parameter generated by the sound source driver. The waveform thus generated is stored in a waveform buffer for later reproduction. Then, at the sound timing, the waveform is read out from the waveform buffer for the reproduction. However, by this method, a mass-storage for the waveform buffer comes to be required for storing the waveform generated in advance. Moreover, in the midpoint of music performance, upon operation of a tone volume control, pan control and effect control, correcting of the music tone waveform becomes difficult, since the music tone waveform of each part or channel of the sound source has been already synthesized. For example, in order to effect the correction, the music tone waveform of sixteen parts should be stored in the waveform buffer independently from each other, whereby a further mass-storage waveform buffer is required.

SUMMARY OF THE INVENTION

Therefore, the object of the present invention is to provide a method of generating a music tone which is volume-controllable as well as the number of computable music tones is not reduced, even though music events increasing the CPU load such as Note-On event suddenly occur simultaneously.

In order to solve the above described problems, the inventive method of generating a music tone by means of a sound source comprises a first step of writing a sequence of event data together with timing data in a first memory section, each event data indicating a music event of a music tone, and each timing data indicating an occurrence timing of each music event, a second step of retrieving each event data from the first memory section to create control parameters for use in control of the sound source to produce a waveform of the music tone, and storing the control parameters together with the corresponding timing data in a second memory section, a third step of operating the sound source based on the control parameters and the timing data stored in the second memory section to effect production of the waveform of the music tone, and storing the waveform in a third memory section, a fourth step of sequentially retrieving the waveform from the third memory section to reproduce the music tone of each music event, a fifth step of regulating a first timing along with progression of the reproduction of the music tone to trigger the third step at the first timing such that the production of the waveform is regulated along with the occurrence timing of each music event, and a sixth step of regulating a second timing independently of the occurrence timing of the music event to trigger the second step at the second timing such that the creation of the control parameters is regulated separately from the occurrence timing of each music event. By such a method of generating a music tone, at the second timing or asynchronous timing separated from the timing to perform the music event data, the control parameter is formed based on the music event data. Therefore, even though the music event data is tight, for the generation processing of the control parameter, the ability of the processor cannot be dissipated excessively, and the waveform generation processing cannot become seriously affected.

The inventive method utilizes a processor to carry out the generation of the music tone based on the event data and the timing data. In such a case, the sixth step checks a work load of the processor to issue the second timing when the work load is relatively light and otherwise to suspend issuance of the second timing when the work load is relatively heavy. By such a manner, the production of the control parameters can be intermittently executed in disperse manner along the time axis when the work load of the processor is relatively light. Otherwise, the sixth step issues the second timing every time the processor counts a predetermined interval by means of a software timer. By such a manner, the production of the control parameters can be carried out in disperse manner along the time axis at a frequency determined by the software timer. The software timer may skip the count when the processor is busy due to heavy work load to thereby avoid concentration of the process.

Preferably, the second step creates a complete set of control parameters necessary for generating a music tone of one music event each time the second step is triggered in response to the second timing. By such a manner, if a plurality of musical events successively occur during a short period, the production of the control parameter corresponding to each musical event can be conducted in disperse manner along the time axis. Otherwise, the second step creates a complete set of control parameters necessary for generating a music tone of one music event after the second step is triggered repeatedly in response to a sequence of the second timings. The work amount for production of the control parameter depends on types of the music events to be processed. The control parameters corresponding to a music event requiring a relatively great amount of the work can be produced a portion by portion in disperse manner to thereby avoid concentration of the work load.

The inventive method further comprises a step of detecting if event data remains in the first memory section before the third step is triggered to produce the waveform of the music tone corresponding to the remaining event data for triggering the second step to create the control parameters of the remaining event data so as to enable the sound source to produce the waveform according to the control parameters derived from the remaining event data. By such a method of generating a music tone, if the generation of the control parameter by the disperse processing is not completed at the time of the tone generation, the music tone generation is performed after completing the control parameter processing not yet completed even in case that it comes to the timing of the music tone generation, whereby no serious influence affects on the music tone. Moreover, in this case also, a part of the control parameters can be processed in disperse manner along the time axis.

According to the invention, the music event data received is stored in a buffer memory. The sound source driver is designed to generate the control parameter by performing the disperse processing of the music event data stored in the buffer memory asynchronously to the progression of the tone generation. Therefore, even though the events occur simultaneously, the sound source driver processing is executed in disperse manner along the time axis, whereby the load of the CPU cannot be increased suddenly. Therefore, the decrease of the number of music tones due to concentration of temporary processing can be prevented. In addition, the sound source driver processing is designed to be executed in advance, and the music tone generation is designed to be executed just at the moment of the tone generation timing. Therefore, for the music tone to be generated, the processing of pan control and volume control can be performed in real time.

DETAILED DESCRIPTION OF PREFERRED EMBODIMENTS

Figure 1:
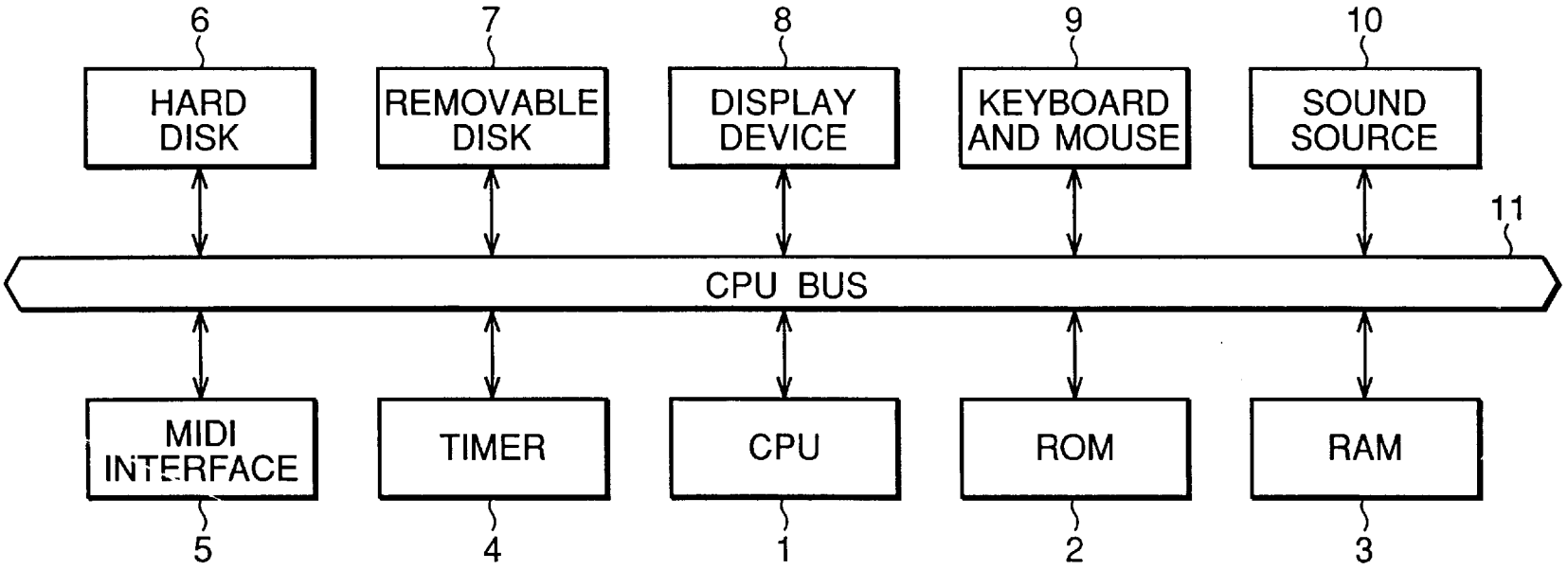
FIG. 1 is a block diagram showing a constitution example of a music apparatus executing a method of generating a music tone according to the invention.

A constitution example of a music apparatus capable of executing the method of generating a music tone according to the invention is shown in FIG. 1. The music apparatus shown in FIG. 1 is basically the same as a general purpose processing apparatus such as a personal computer and a workstation. On these apparatuses, the method of generating a music tone according to the invention can be embodied. In this drawing, a reference numeral 1 denotes a microprocessor or central processing unit (CPU) performing an automatic musical performance on the basis of music data obtained by executing an application program to read a file of a music score. A reference numeral 2 denotes a read only memory (ROM) in which an operation program of the CPU 1 and a preset tone color data are stored. A reference numeral 3 denotes a random access memory (RAM) having storage areas such as a work memory area, an input buffer area (M buffer), a control parameter area (P buffer), a part setting data area, a sound source register area and an output buffer area. A reference numeral 4 denotes a timer counting a clock as well as indicating a timing of a timer interrupt to the CPU 1. A reference numeral 5 denotes a MIDI interface, into which MIDI event data is entered, and from which MIDI event data is sent out. A reference numeral 6 denotes a hard disk in which are stored music tone waveform data used for generating music tones, an operation system (OS), a program implementing the method of generating a music tone according to the invention and various application programs. At operation by the CPU 1, the program implementing the method of generating a music tone is loaded from the hard disk 6 to the RAM 3. A reference numeral 7 denotes a removable disk held in a drive device. The removable disk 7 is a replaceable memory medium or machine readable medium such as an optical disk or a CD-ROM in which the music tone waveform data, the OS and various application programs are stored for generating the music tones. A reference numeral 8 denotes a display (a monitor) by which a user interacts with the music apparatus. A reference numeral 9 denotes a keyboard designed as an input device for a personal computer. The keyboard 9 is provided with keys to input English letters, Japanese Kanas, numeric characters and symbols. The input device may contain a mouse tool which is a kind of pointing device. A reference numeral 10 denotes a hardware sound source, which is constituted of a sound card on which a DSP is mounted. When the music apparatus is provided with a software sound source, the hardware sound source 10 is not necessary. A reference numeral 11 denotes a CPU bus through which data is exchanged. Moreover, through a network interface (not shown), programs and data can be downloaded from an external network.

As described above, the RAM 3 provides the memory areas in which various data are temporarily stored. An example of contents of each area is shown in a section (a) of FIG. 2. Especially, an example of the contents of the P buffer area is shown in a section (b). An example of the contents of the M buffer is shown in a section (c). As shown in the section (a), the RAM 3 provides each memory area of music part setting data, a sound source register and a sound source work area in addition to the M buffer and the P buffer. Further, an output buffer area may be provided in the RAM if desired. The output buffer is not necessarily required in the RAM 3. The area of the output buffer may be designed to be established in the hard disk 6 or the removable disk 7.

The M buffer memorizes the music data of a MIDI format read out from the MIDI file stored in the hard disk 6 or the removable disk 7. The M buffer may memorize MIDI events such as Note-On event, Note-Off event and program change event entered through the MIDI interface 5 together with a receiving time of each event. The receiving time can be counted in terms of clocks of the timer 4. The contents of the M buffer in which the MIDI events are written are shown in the section (c) of FIG. 2. A duration and a MIDI event are written as a set. The duration indicates a time interval between the receiving time of a preceding MIDI event received immediately before receiving of a succeeding MIDI event, and the receiving time of the succeeding MIDI event received after the preceding MIDI event. Moreover, in the example shown in this drawing, the number of the data set is indicated to be "2", whereby two sets of the duration and the event are stored in the M buffer.

The M buffer is handled as a ring buffer. An address of a read pointer and an address of a write pointer are used to indicate a particular location of the M buffer. The sound source driver can read out the event data to which the sound source driver processing is not yet applied from the location of the M buffer indicated by the read pointer to execute the sound source driver processing. According to the read pointer address of the M buffer, the CPU reads out the data set of the duration and the event from the relevant address location of the M buffer to execute the sound source driver processing for producing the control parameter responsive to the events data. Furthermore, at MIDI input processing for writing the MIDI event into the M buffer, the write pointer address of the M buffer is used such that the data set of the duration and the event is written in the relevant address location of the M buffer.

In the P buffer, the control parameter generated by the sound source driver processing is stored in the form of the set with the corresponding duration data. The contents of the P buffer are shown in the section (b) of FIG. 2. The value of the duration data is the same as the duration data combined with the event data to which the sound source driver processing is applied when the event data is stored in the M buffer. Moreover, in the example shown in this drawing, the number of data sets is indicated to be "3", whereby three sets of the duration and the event are stored in the P buffer. The P buffer is also treated as a ring buffer. An address of the read pointer and an address of the write pointer are utilized to indicate a particular location of the P buffer. It is determined whether the tone generation timing arrives or not by detecting the duration data memorized at the location designated by the read pointer. When the tone generation timing arrives, the relevant control parameter can be sent to the sound source register. Storage of the control parameter generated by the sound source driver processing to the P buffer can be performed by means of the write pointer.

Moreover, the music part setting data area memorizes a tone color selection data, a tone volume data, a tone image orienting (pan) data or the like a part by part basis. At starting of the tone generation, on the basis of the tone color data designated by the tone color selection data, an address control parameter of the waveform data used in the music tone generation and various EG control parameters of an envelope waveform or the like are generated. On the basis of the tone volume data and the pan data, a tone volume control parameter is generated. These control parameters are loaded into a storage region of the sound source register, corresponding to a channel to which the music event is assigned to initiate the tone generation.

Figure 3A:
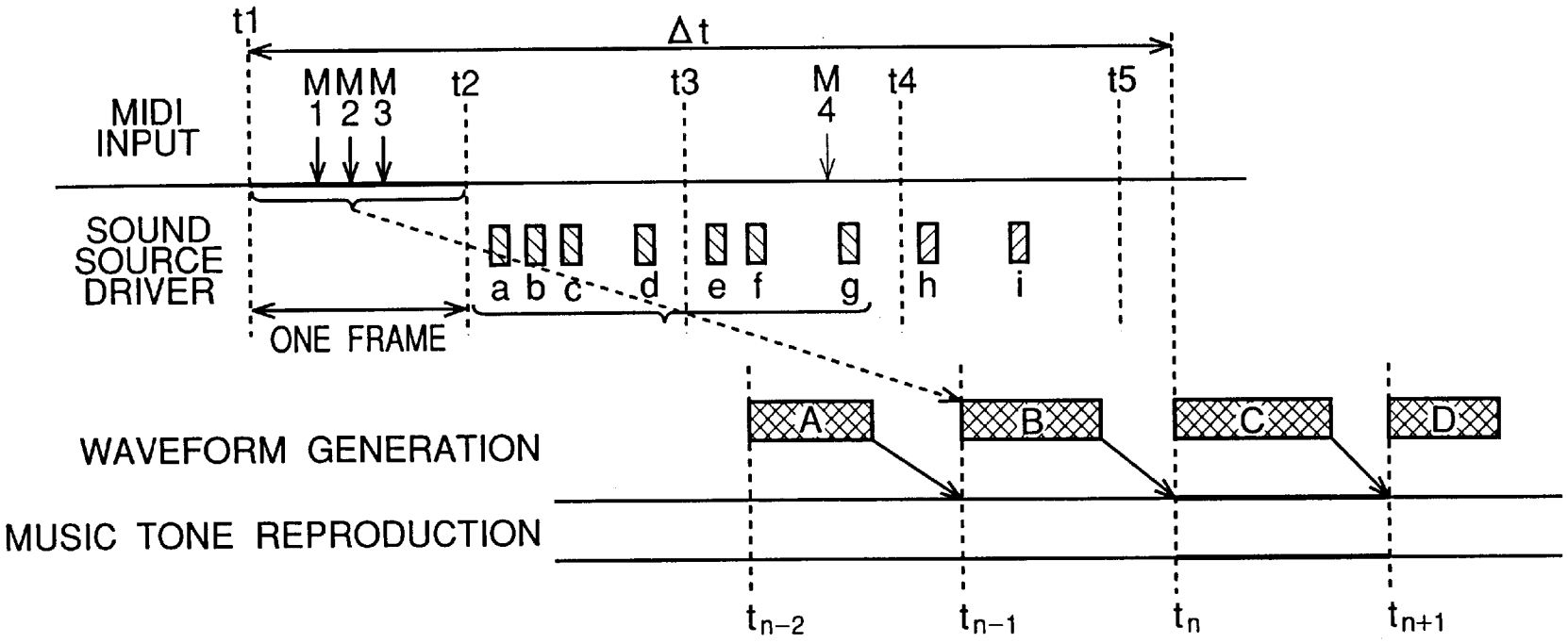
FIG. 3A is a timing chart showing process of the method for generating a music tone according to the invention.
Figure 3B:
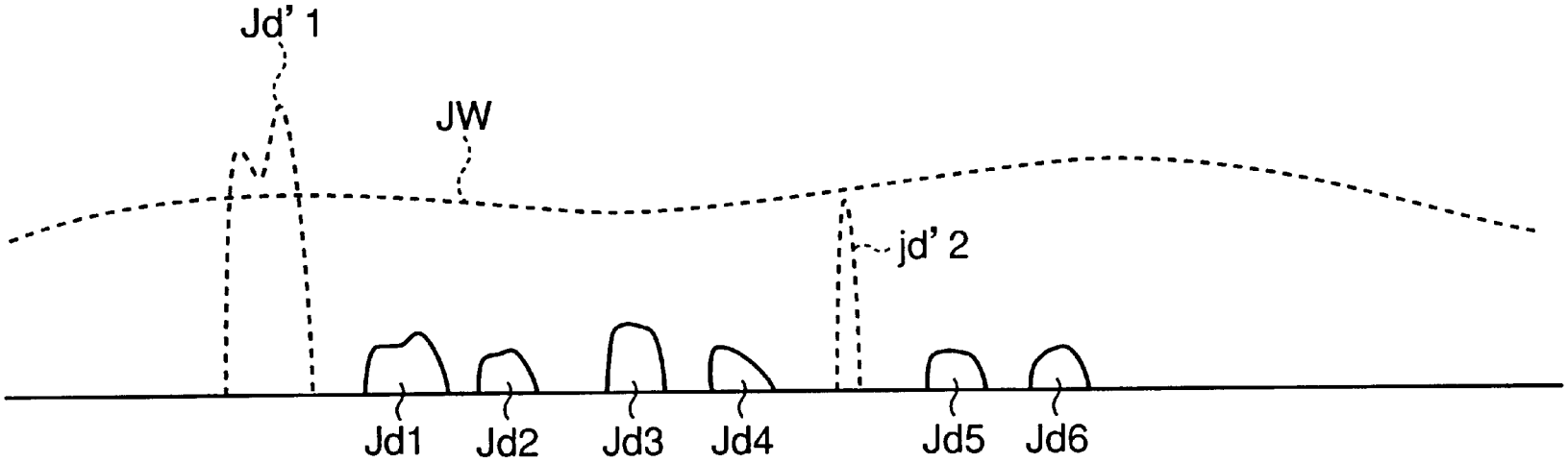
FIG. 3B is a diagram showing changes in a load quantity of sound source driver processing and a load quantity of waveform generation processing.

Next, on the basis of a timing chart, the description is given for the method of generating a music tone according to the invention executed by the music apparatus of the configuration shown in FIG. 1. FIG. 3A shows timings of MIDI input processing, sound source driver processing, music tone waveform generation processing and music tone reproduction processing. FIG. 3B shows a difference of distribution of work load between the sound source driver processing and music tone waveform generation processing of the prior art, and the sound source driver processing and music tone waveform generation processing of the invention responsive to the MIDI input. First, as shown in FIG. 3A, in the frame period from the timing t1 to t2, the concentrated or crowded MIDI events M1, M2 and M3 are received successively. These MIDI events M1, M2 and M3 are written sequentially in the M buffer in combination with the timing data or duration data responsive to the event receiving time.

Moreover, as shown in FIG. 3A, in the period from a subsequent frame starting with the timing t2, the sound source driver processing "a" to "g" are performed. At this point, the data constituted of the set of the duration and the MIDI event are read out from the M buffer, and the sound source driver processing is executed in disperse manner along the time axis. In the example illustrated, the sound source driver processing responsive to the MIDI events M1, M2 and M3 is executed in the disperse manner at seven times of the steps "a" to "g".

In the sound source driver processing, the control parameter responsive to the event is generated and is written into the P buffer together with the corresponding duration data or timing data. Moreover, when the time of reading the music tone waveform sample in the waveform generation processing reaches according to the time of the duration combined with the control parameter stored in the P buffer, the relevant control parameters are loaded from the P buffer to the sound source register. On the basis of the loaded control parameters, the sound source engine executes the music tone waveform generation processing. In the example illustrated, the music tone waveform generation processing B corresponding to the events M1 to M3 is executed in the period of the frame starting at the timing tn−1,. The control parameters generated in response to the MIDI events M1, M2 and M3 and stored in the P buffer are loaded into the sound source register at the time position designated by the corresponding duration data, respectively. In response to the contents of the sound source register updated at the timing, the music tone waveform sample is generated. At completion of each waveform generation processing A, B, . . . , the output buffer stores one frame of the music tone waveform samples, which are reserved for reproduction by the reproduction device.

Moreover, in the period of the frame starting with the timing tn, the music tone reproduction processing is performed. The music tone waveform is read out at each sampling period a sample by sample from the output buffer. The read waveform is converted into the analogue waveform of the music tone by the DAC to be sounded. Therefore, the total delay time Δt at this time becomes the time period from the timing t1 to the timing tn. For example, the total delay time Δt can be reduced to approximate 1 sec. One frame is defined as a time period of several milliseconds.

Moreover, in the frame period from the timing t3 to t4, the MIDI event M4 is entered. In the same manner, the MIDI event M4 is written into the M buffer in the form of the set combined with the duration data responsive to the receiving time. Further, as shown in the sound source driver processing of FIG. 3A, at the period of the subsequent frame starting with the timing t4, the data constituted of the set of the duration and the MIDI event is read out from the M buffer. Furthermore, the sound source driver processing responsive to the read event M4 such as the channel assignment processing and the control parameter generation processing or the like are executed in disperse manner along the time axis. Moreover, when the time of reading the music tone waveform sample to be generated by the waveform generation processing reaches the time of the duration combined with the control parameter stored in the P buffer, the relevant control parameter is sent from the P buffer to the sound source register. On the basis of the control parameter, the music tone waveform generation processing is executed by the sound source engine. As a result, in the waveform generation processing C, at the midpoint of the frame starting with the timing tn, the music tone waveform samples changing in response to the MIDI event M4 are generated and reserved for reproduction by the reproduction device.

Incidentally, in the prior art method of generating a music tone, when the MIDI event is entered, the sound source driver processing is executed instantly in real time. Therefore, when the MIDI events are entered simultaneously, the work load of the sound source driver processing is increased suddenly. This condition is shown in FIG. 3B. Concerning the sound source driver processing where the MIDI events M1, M2 and M3 are entered simultaneously, it is shown by a dashed line that the work load is increased suddenly (the quantity of the sound source driver processing Jd'1). Moreover, concerning the quantity of the sound source driver processing where the MIDI event M4 is entered, it is shown by the dashed line that the work load is increased momentarily (the quantity of the sound source driver processing Jd'2).

Thus, in the prior art, since the quantity of the sound source driver processing is increased suddenly, the processing quantity being assigned to the sound source is decreased as tradeoff, whereby the number of concurrent music tones is affected. In contrast with the prior art, according to the invention, the sound source driver processing is executed in disperse manner along the time axis. As shown in FIG. 3B, the quantity of the sound source driver processing becomes a total of the processing quantity Jd1 to the processing quantity Jd6 dispersed by a small quantity.

Thus, in the method of generating a music tone according to the invention, when the MIDI events M1, M2 and M3 are entered in concentrating manner, the sound source driver processing is performed by dispersing the work load into the processing quantity Jd1 to the processing quantity Jd4 by a small quantity, as shown in FIG. 3B. Since the quantity of the sound source driver processing is not increased suddenly, the sufficient processing quantity can be assigned to the sound source engine processing even though the events are entered simultaneously. Moreover, when the MIDI event M4 is entered, as shown in FIG. 3B, the work load is dispersed by a small quantity, whereby the sound source driver processing is performed momentarily. These processing quantities Jd5 and Jd6 are increased suddenly, though no influence exerts upon the number of concurrent music tones. Generally, the quantity Jw of the waveform generation processing being executed by the sound source engine fluctuates in response to the number of music tones. However, due to the continuity of music sound, the work load Jw cannot be increased suddenly. Although the processing quantity Jw is in high volume, the quantity Jw comes to vary gradually as shown in FIG. 3B.

As described above, the inventive method is designed for generating a music tone by means of a sound source. In a first step, the MIDI input processing is performed for writing a sequence of event data together with timing data in a first memory section in the form of the M buffer. Each event data indicates the music event M1 to M4 of a music tone, and each timing data indicates an occurrence timing of each music event M. In a second step, the sound source driver processing is performed for retrieving each event data from the first memory section to create control parameters prepared to control the sound source in production of a waveform of the music tone, and for storing the control parameters together with the corresponding timing data in a second memory section in the form of the P buffer. In a third step, the music tone waveform generation processing A to D is performed for operating the sound source based on the control parameters and the timing data stored in the second memory section to effect the production of the waveform of the music tone, and for storing the waveform in a third memory section in the form of the output buffer. In a fourth step, the music tone reproduction processing is performed for sequentially retrieving the waveform from the third memory section to reproduce the music tone of each music event. A fifth step is conducted for regulating a first timing "tn−2" to "tn+1" along with progression of the reproduction of the music tone to trigger the third step at the first timing such that the production of the waveform is regulated along with the occurrence timing of each music event M1 to M4. A sixth step is conducted for regulating a second timing "a" to "i" independently of the occurrence timing of the music event M1 to M4 to trigger the second step at the second timing "a" to "i" such that the creation of the control parameters is conducted separately from the occurrence timing of each music event.

The inventive method utilizes a processor in the form of the CPU 1 to carry out the generation of the music tone based on the event data and the timing data. In such a case, the sixth step checks a work load of the processor to issue the second timing when the work load is relatively light and otherwise to suspend issuance of the second timing when the work load is relatively heavy. Alternatively, the sixth step issues the second timing every time the processor counts a predetermined interval by means of a software timer.

Preferably, the second step creates a complete set of control parameters necessary for generating a music tone of one music event each time the second step is triggered in response to the second timing. Otherwise, the second step creates a complete set of control parameters necessary for generating a music tone of one music event after the second step is triggered repeatedly in response to a sequence of the second timings.

The inventive method further comprises a step of detecting if event data remains in the first memory section before the third step is triggered to produce the waveform of the music tone corresponding to the remaining event data for triggering the second step to create the control parameters of the remaining event data so as to enable the sound source to produce the waveform according to the control parameters derived from the remaining event data. Preferably, as will be described later in detail, the inventive method further comprises a step of rewriting the control parameters stored in the second memory section before the control parameters are used by the sound source when the music event is altered after the control parameters corresponding to the music event are created and stored in the second memory section.

Figure 4:
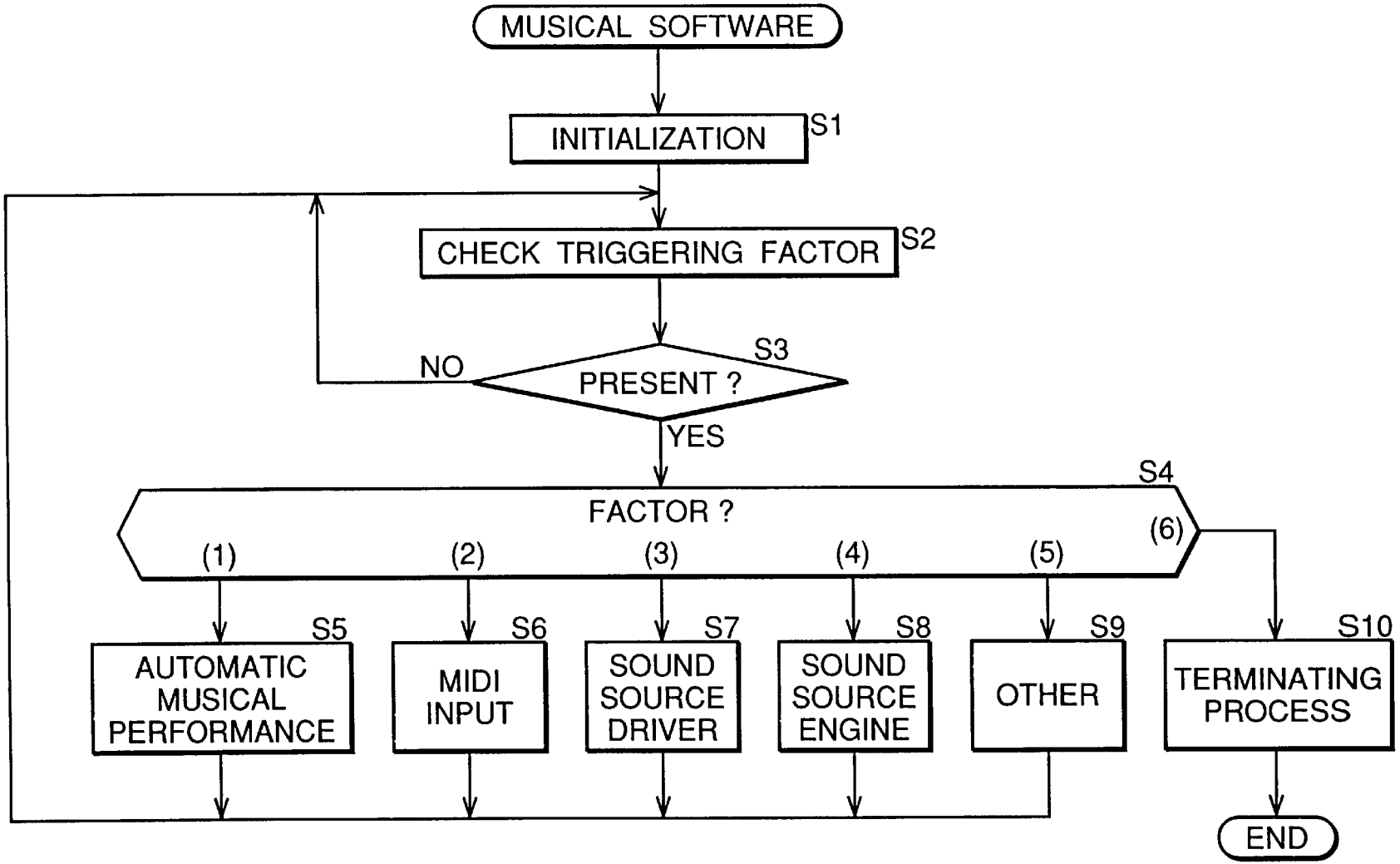
FIG. 4 is a flowchart of a music software performance presented by the method of generating a music tone according to the invention.

Next, FIG. 4 shows a flowchart of the method of generating a music tone according to the invention executed by the music apparatus shown in FIG. 1 as the application software (a music software) of the automatic musical performance. When the music software processing is started, step S1 is conducted for clearing of various registers and initialization such as preparation processing of a screen displaying on the display device 8. Secondly, in a step S2, check as to whether triggering factors are present or not is performed. There are triggering factors of six types;

(1) the time reaches an occurrence timing of the music event in the automatic performance, (2) it is the timing that the MIDI event is entered, (3) it is detected that a margin is created in the ability of the CPU (an available free time slot), or it is detected by a software timer that a certain period (for example, one frame of time) is lapsed, (4) it is the timing that the process of one frame has completed, (5) it is the timing that a double click of a mouse button is made for commanding reproduction of the music data or a tone volume control operation is performed, and (6) it is the timing that a mouse button is double-clicked for exiting the program.

In the triggering factor (3), using the method of "the detection of the available time slot", when the work load of the CPU is not heavy, the sound source driver processing can be executed in disperse manner along the time axis. Alternatively, using the method of "the detection of the lapse of a certain period", the sound source driver processing can be dispersed throughout the certain time period. Varying the length of the certain time period by a parameter, the degree of the dispersion of the sound source driver processing can be controlled.

Then, it is determined at a step S3 as to whether there is at least one triggering factor of six types or not. When it is detected that the triggering factor occurs, the routine goes to a step S4. When no triggering factor is detected, the routine returns to the step S2 and occurrence of the triggering factor is waited on standby. In the step S4, when the triggering factor (1) is detected, the automatic musical performance processing is performed in a step S5 to thereby return to the step S2. In this automatic musical performance, the processing is performed for generating the MIDI event according to the music data read out from the MIDI file in the timing determined by the music score. Moreover, the MIDI event generated in response to the triggering factor (1) becomes a subsequent triggering factor (2) as an input event.

Figure 5:
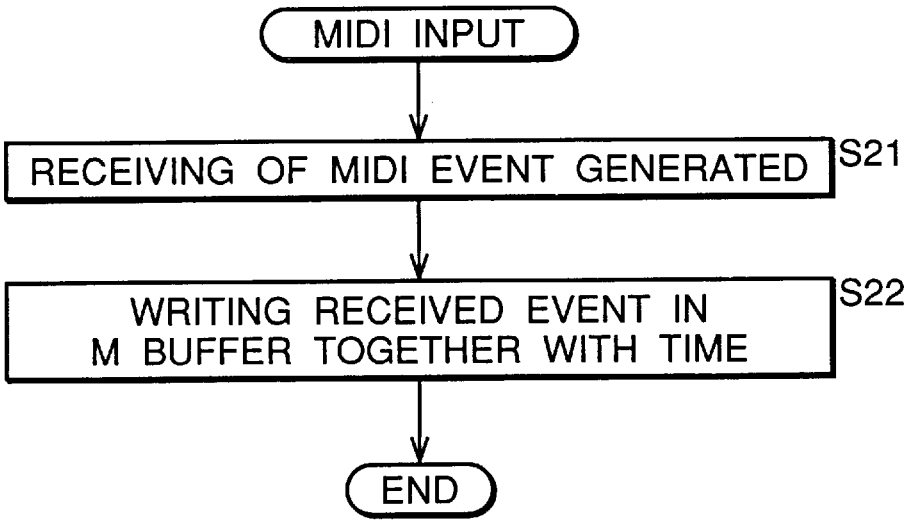
FIG. 5 is a flowchart of MIDI input processing performed in the method of generating a music tone according to the invention.

Moreover, when the triggering factor (2) is detected, the routine goes from the step S4 to a step S6 to perform the MIDI event input processing to thereby return to the step S2. The flowchart of this MIDI event input processing is shown in FIG. 5. When the MIDI event input processing is started, the MIDI event is received in a step S21. Subsequently, in a step S22, write processing of the MIDI event received into the M buffer is performed. According to this operation, the MIDI events entered are written into the M buffer sequentially.

Figure 6:
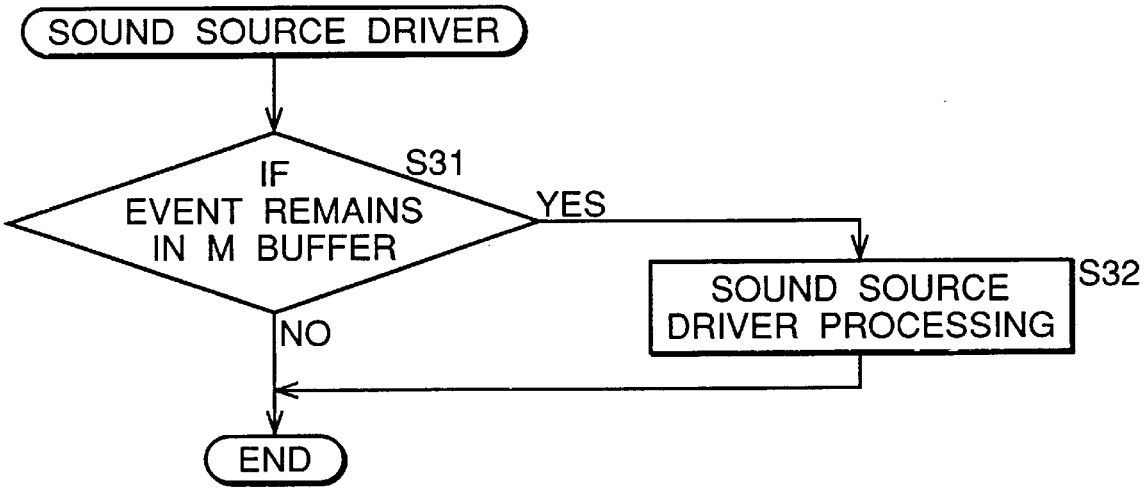
FIG. 6 is a flowchart of sound source driver processing in the method of generating a music tone according to the invention.

Furthermore, when the triggering factor (3) is detected, the routine goes from the step S4 to a step S7 to perform the first sound source driver processing to thereby return to the step S2. The flowchart of this sound source driver processing is shown in FIG. 6. When the sound source driver processing is started, it is determined in a step S31 as to whether an unprocessed event for which the sound source driver processing has not been completed is present or not in the M buffer. At this point, when there is the unprocessed event for which the sound source processing has not been completed, the routine branches to a step 32 to carry out the sound source driver process in disperse manner along the time axis as shown by the distributed quantities Jd1 to Jd6 of the sound source driver process in FIG. 3A. On the other hand, if unprocessed events are not found, the first sound source driver process is skipped.

Figure 2:
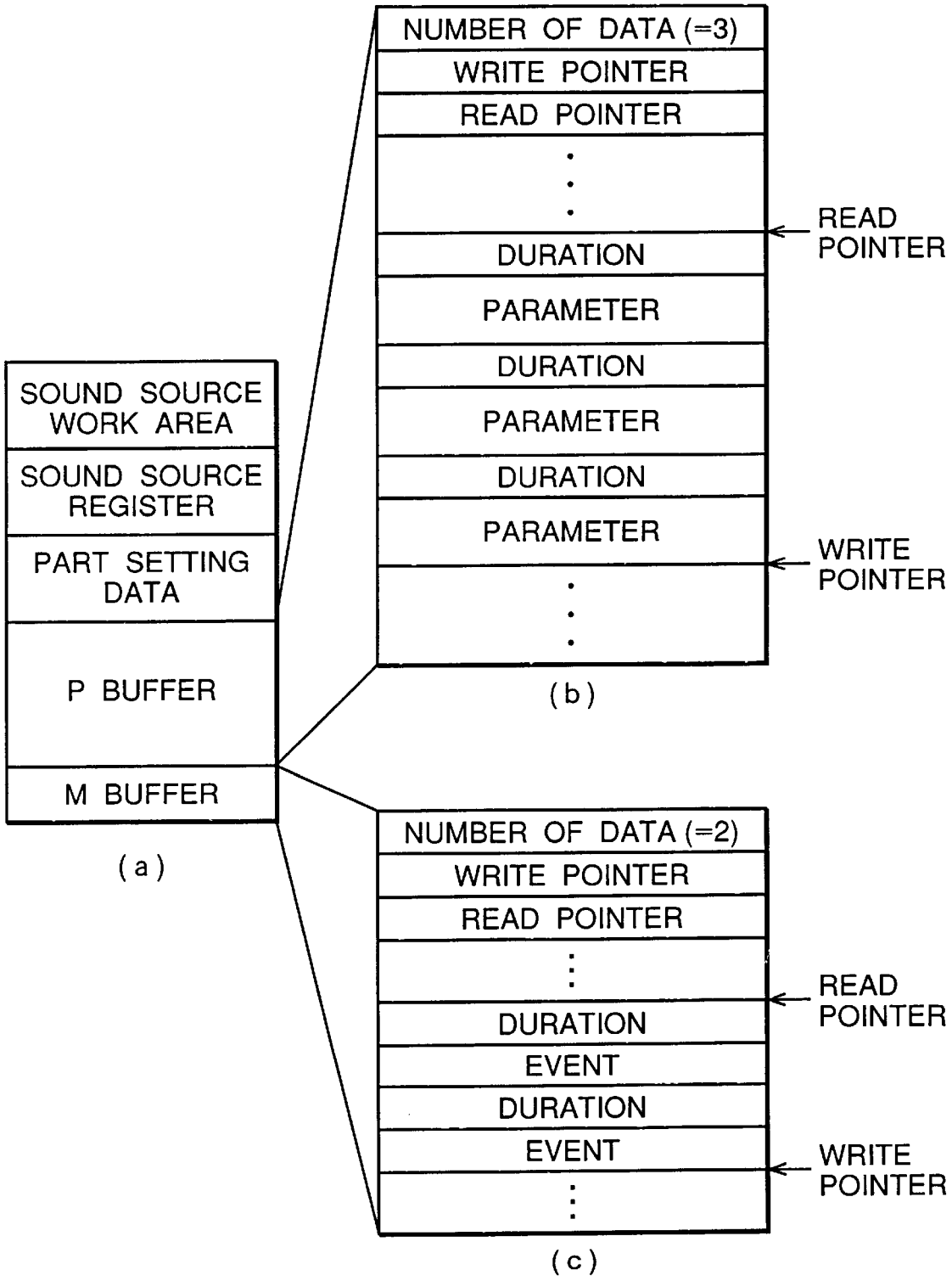
FIG. 2 is a view showing various buffer memory sections set on a RAM of the music apparatus according to the invention.

Moreover, for the detection of the unprocessed event in the sound source driver processing, it is sufficient to simply check that the number of the remaining event data in the M buffer shown in the section (c) of FIG. 2 is one or more. That is, by accessing the portion in which the number of the stored event data is written, the presence or absence of the unprocessed event can be detected. When the unprocessed event is present, the event data is read out from the address designated by the read pointer, whereby the control parameter generation processing is performed for the remaining unprocessed events. The number of the stored event data written in the M buffer indicates the number of unprocessed event data for which the sound source driver processing has not been terminated. This number of the event data corresponds to the number of the event data left between the write pointer address and the read pointer address. Every time the sound source driver processing of each event is terminated, the read pointer is moved to the address location specified by the duration data of the subsequent event, whereby the number of the stored or remaining event data is decremented by "1".

Figure 7:
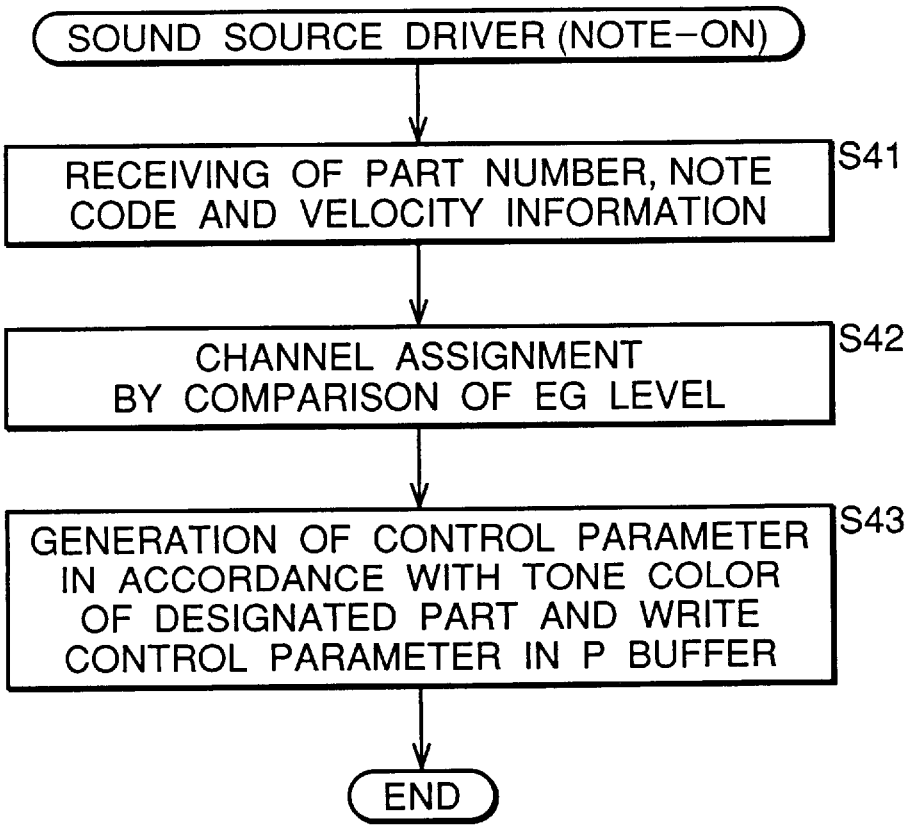
FIG. 7 is a flowchart of sound source driver Note-On processing in the method of generating a music tone according to the invention.

Subsequently, FIG. 7 shows a flowchart of the sound source driver processing performed in case that the MIDI event is the Note-On event, as one example of the sound source driver processing performed in the step S32. When the sound source driver processing of Note-On is started, for performing tone generation start preparation in a step S41, part number information, a note code and velocity information included in the event data are received. Subsequently, in a step S42, assignment of the channel to be activated is performed by last-in first-out mode. In the embodiment, the control parameter of a new music tone is produced in advance, but there may be no vacant channel to be assigned to the new music tone. In such a case, an active channel assigned to the oldest music tone is truncated to make the active channel free for the new music tone according to the last-in first-out mode. However, the channel assigned with a bass music tone may be precluded from the last-in first-out mode for better performance of the music.

Subsequently, in a step S43, in accordance with the tone color of the designated part, the control parameter is generated. The control parameter generated is written in the P buffer. Moreover, in the example shown in FIG. 7, both of the processing of the step S42 and the step S43 are designed to be executed by the sound source driver processing of Note-On at one time. Otherwise, in the sound source driver processing of Note-On, one of the processing of the step S42 and the step S43 may be designed to be performed at one time, whereby a pair of the two processing are performed by the sound source driver processing at two times. Moreover, in the step S43, the control parameter may be designed to be generated by a fraction of "n" in the sound source driver processing of Note-On each time.

Figure 8A:
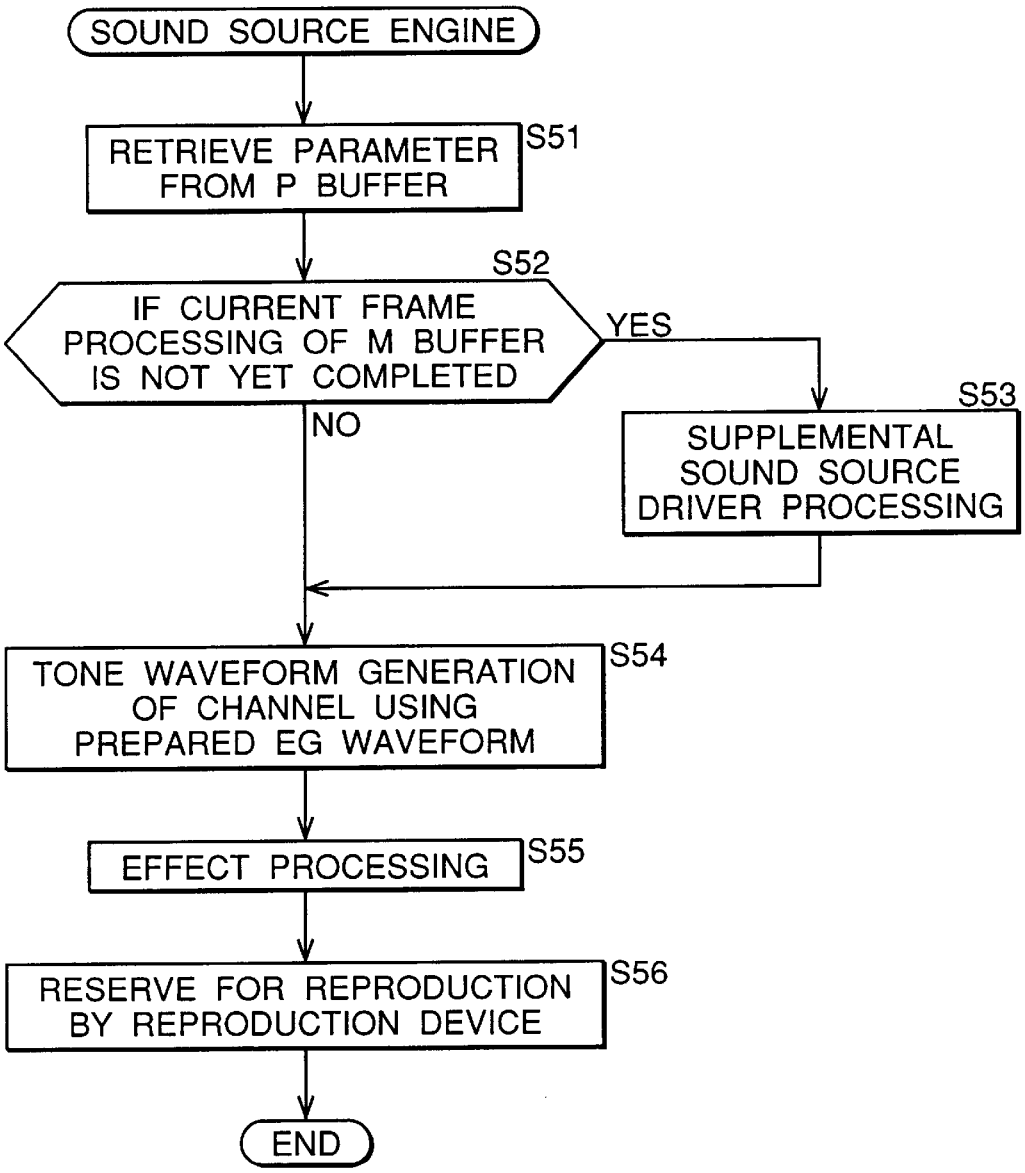
FIG. 8A and FIG. 8B are flowcharts of sound source engine processing, and volume control processing in the method of generating a music tone according to the invention.

Returning to the flowchart shown in FIG. 4, when the triggering factor (4) is detected, the routine goes from the step S4 to a step S8 to perform the sound source engine processing for generating the music tone waveform sample to thereby return to the step S2. The flowchart of this sound source engine processing is shown in FIG. 8A. At top of each frame, the sound source engine processing is started. First, in a step S51, reproduction of the control parameter read out from the P buffer is performed. The control parameter for which the sound timing arrives is sent from the P buffer to the sound source register. Subsequently, in a step S52, along the time range of the current frame, it is determined as to whether there is an unprocessed event in the M buffer, for which the sound source driver processing is not yet completed. Since the sound source driver processing is performed in disperse manner along the time axis, in spite of arriving at the sound timing, there may exist the case that all the control parameters required to generate the tone waveform are not yet obtained. Therefore, the step S52 is performed in order to detect this case.

At this point, when it is detected that the sound source driver processing for the relevant event is not yet completed, a step S53 conducts second or supplemental sound source driver processing for generating the control parameter corresponding to the event which is unprocessed within the regular time range. According to this operation, all the control parameters necessary for generating the waveform of the music tone have been prepared. Moreover, when it is detected that there is no event for which the sound source driver processing has not been terminated, the step S53 is skipped. Then, in a step S54, the music tone waveform samples responsive to the control parameter stored in the sound source register are formed by the number corresponding to one frame time period. Within one frame, a plurality of channels of the waveform samples are mixed and stored in the output buffer. Subsequently, in a step S55, effect processing is applied to the music tone waveform samples, which are again accumulated in the output buffer. Then, in a step S56, the music tone waveform samples of the output buffer are reserved for reproduction by the reproduction device. According to this operation, in the subsequent frame, the waveform of the music tone is read out at each sampling period a sample by sample basis from the output buffer, and is converted into the analogue music tone signal by the reproduction device such as the DAC for sounding of the music tones.

Returning to the flowchart shown in FIG. 4, when the triggering factor (5) is detected, the routine goes from the step S4 to a step S9 where other processing is performed to thereby return to the step S2. As the other processing, there is automatic performance processing performed when the automatic performance button of the input device is double-clicked to designate automatic performance, or tone volume control processing performed when an operator sets the tone volume a part by part basis. The automatic performance processing is started, when the button of the mouse device is double-clicked on an icon of a desired music data file and the automatic performance is designated. The music data thus designated is read out such that the MIDI file stored in the hard disk 6 or the removable disk 7 is accessed, and the processing according to the automatic performance is executed. The automatic musical performance described relating to the step S5 is performed.

Figure 8B:
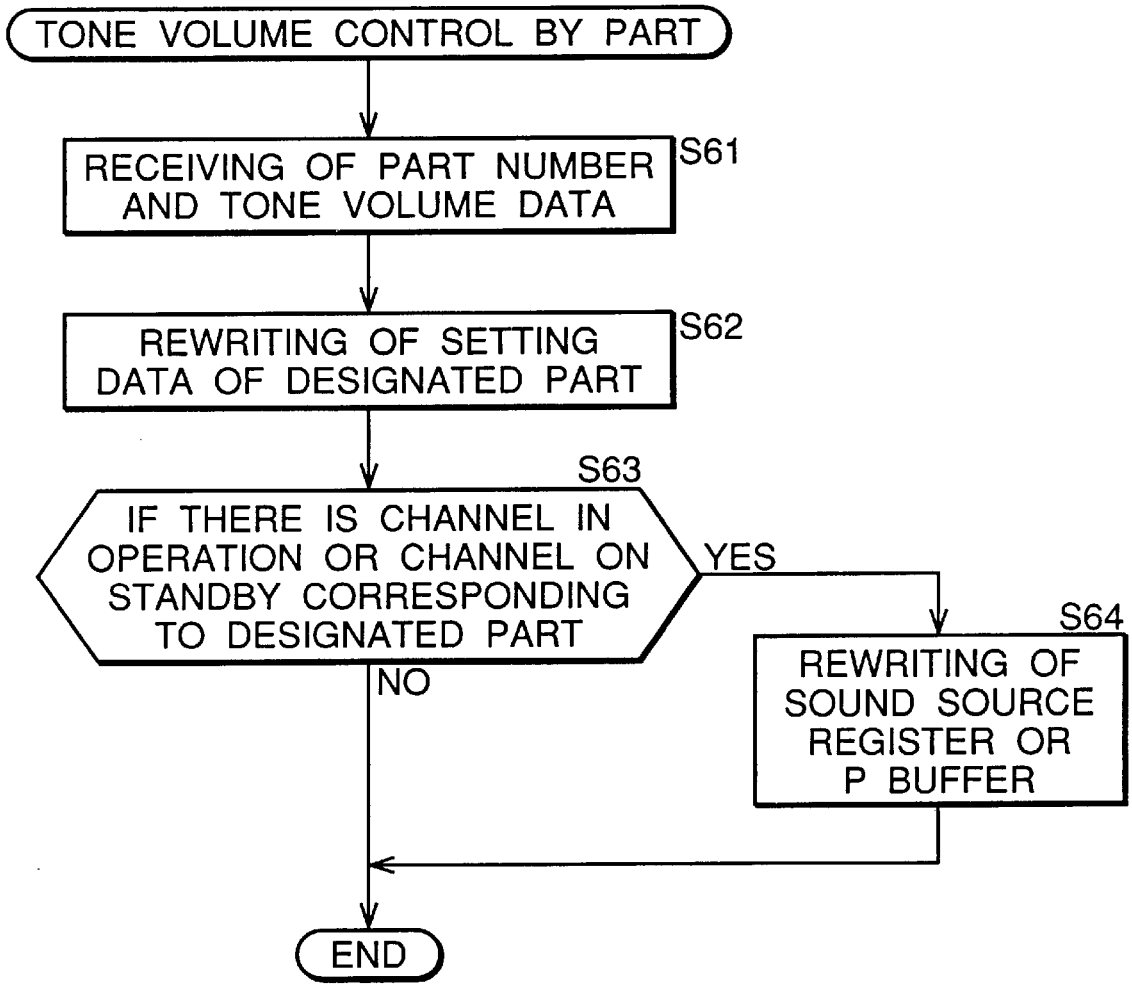
Figure 9:
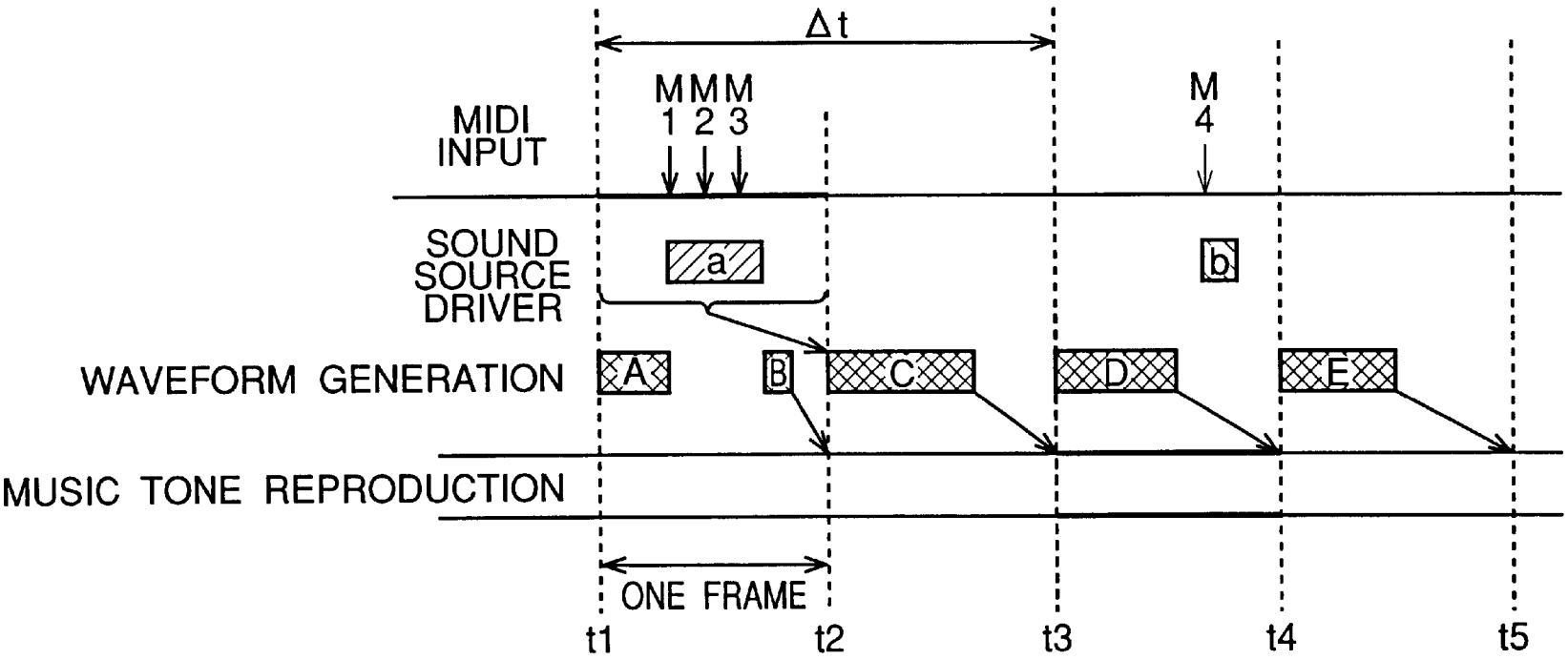
FIG. 9 is a timing chart showing a conventional method of generating a music tone.

Moreover, when the operator sets the tone volume a part by part basis, the tone volume control processing is performed as shown in a flowchart of FIG. 8B, whereby the tone volume control processing by part is executed. In the flowchart shown in FIG. 8B, when the tone volume control processing is started, a part number designating a part subjected to the volume control and the tone volume data set in the part are received in a step S61. Subsequently, the setting data of the tone volume of the designated part is rewritten in a step S62 according to the operation amount of the input device by the user. This setting data is stored in the part setting data area of the RAM 3 shown in the section (a) of FIG. 2. Subsequently, it is determined in a step S63 as to whether the channel of the part designated which is in operation or on standby is present or not. At this point, when the channel which is in operation or which is on standby such that the control parameter is still stored in the P buffer is detected, the routine goes to a step S64.

In this step S64, when the channel which is in operation is detected, the tone volume data corresponding to the detected channel in the sound source register is rewritten in response to the control input from the operator panel of the input device. Otherwise, when the channel which is on standby is detected, the tone volume data corresponding to the detected channel in the P buffer is rewritten in response to the control input from the operator panel. When the channel of the designated part which is in operation or on standby is not detected, the processing of the step S64 is skipped. Moreover, when the total delay time Δt shown in FIG. 3A is set within 1 sec, the tone volume data of the channel which is on standby may be rewritten. In this case, the tone volume data set renewedly is used for only the MIDI event occurring thereafter. Thus, even though the control parameter is generated intermittently prior to the tone generation timing, since the waveform of the music tone is not generated until the tone generation timing arrives, the tone volume control processing a part by part basis can be performed in real time.

Returning to the flowchart shown in FIG. 4, when the triggering factor (6) is detected, the routine goes from the step S4 to a step S10 to perform terminating process such as erasing a display of the associated screen in order to terminate the software sound source processing. In the various triggering factors, priorities of the triggering factor (1) and (2) are defined as highest, priority of the triggering factor (4) as high secondly, priority of the triggering factor (5) as high subsequently and priorities of the triggering factor (3) and (6) as lowest.

As described above, the inventive electronic musical apparatus utilizes the central processing unit or CPU 1 for working various modules to generate music tones, while controlling a work load of the central processing unit. The inventive apparatus is comprised of the player module equivalent to the steps S5 and S6, the driver module equivalent to the step S7, the sound source module equivalent to the step S8 and the timing module equivalent to the step S4 depicted in the main flowchart of FIG. 4. The player module provides a sequence of event data indicating an event of a music tone and timing data indicating an occurrence time of the event. The driver module is intermittently triggered to process the event data for creating control parameters reserved for use in generation of the music tone corresponding to the event data. The sound source module is routinely triggered to load therein the reserved control parameters for generating the music tone according to the timing data. The timing module issues a synchronous trigger signal effective to routinely trigger the sound source module, and issues an asynchronous trigger signal independently of the timing data for intermittently triggering the driver module so as to avoid concentration of the work load of the central processing unit.

Preferably, the timing module checks the work load of the central processing unit so as to issue the asynchronous trigger signal when the work load is relatively light and otherwise to suspend the asynchronous trigger signal when the work load is relatively heavy. Alternatively, the timing module issues the asynchronous trigger signal every time the central processing unit counts a predetermined interval.

Preferably, the driver module creates a complete set of control parameters necessary for generating a music tone of one event each time the driver module is triggered in response to the asynchronous trigger signal. Alternatively, the driver module creates a complete set of control parameters necessary for generating a music tone of one event after the driver module is repeatedly triggered in response to a sequence of the asynchronous trigger signal.

Preferably, as shown in FIG. 8A, the inventive electronic musical apparatus further utilizes a detector module (step S52) that detects if event data remains unprocessed by the driver module until the sound source module is triggered to generate the music tone corresponding to the remaining event data for causing the timing module to trigger the driver module to create the control parameters of the remaining event data (step S53) so as to enable the sound source module to generate the music tone according to the control parameters (step S54). Further, as shown in FIG. 8B, the inventive electronic musical apparatus utilizes a module (step S64) that rewrites control parameters of an event before the control parameters are used by the sound source module when the event is altered after the control parameters are created by the driver module.

According to the above description, the M buffer is set in the RAM 3. It is not necessarily required to set the M buffer in the RAM 3. The M buffer may be set in a region of the music data stored in the hard disk 6 or the removable disk 7, the region being in somewhat preceding to reproduction location. Moreover, the control parameter stored in the P buffer is transferred to the sound source register at the time designated by the duration data of the music event in the disclosed embodiment. Otherwise, when the clock arrives at the time specified by the duration data, the sound source engine may generate the music tone waveform sample on the basis of the control parameter held on the P buffer, thereby using the P buffer as the sound source register.

The delay time Δt shown in FIG. 3A may not be an integer of the time frames, but may be a few frames and two-thirds of one frame. Furthermore, according to the above description, the music event data is expressed by the MIDI format. Without regard to a format, the music event data may be designed to designate a start/stop of music tone, a tone color and a tone volume.

Furthermore, in the disclosed embodiment, at the timing when the sound source engine processing is started, the triggering factor (4) is generated every frame. Without limiting to one frame, one time per two frames or three times per one frame or the like may be determined to periodically generate the triggering factor. In addition, the quantity of the music tone waveform data generated every time the sound source engine is started also cannot be limited to one frame.

In addition, according to the disclosed embodiment of the invention, when the sound source engine processing is started, it is designed to determine first in the step S52 as to whether the production of the control parameter is completed or not, whereby the control parameter which is unprocessed is generated if necessary. This processing may be omitted. In this case, only the control parameters which have been generated at the time of the start are used in the music tone generation, and control parameters which have not been generated are disregarded. The reason why the control parameter cannot be generated in this case is that the entire work load becomes heavy. According to this modification, the alleviation of processing can be reduced. In addition, the method of generating a music tone according to the invention may be executed on general purpose computers, which adopt Windows 95 (Operating System for personal computer of Microsoft Corporation in U.S.A.) or other operating systems to run the software sound source application program in parallel to other application programs such as a game software and a karaoke software.

The machine readable medium or the removable disk 7 is used in the inventive electronic musical apparatus having the central processing unit or CPU 1 for operating various modules to generate music tones while controlling a work load of the central processing unit. The medium contains program instructions executable by the central processing unit for causing the electronic music apparatus to perform the method comprising the steps of operating the player module that provides a sequence of event data indicating an event of a music tone and timing data indicating an occurrence time of the event, operating the driver module that is intermittently triggered to process the event data for creating control parameters reserved for use in generation of the music tone corresponding to the event data, operating the sound source module that is routinely triggered to load therein the reserved control parameters for generating the music tone according to the timing data, and operating the timing module that issues a synchronous trigger signal effective to routinely trigger the sound source module, and that issues an asynchronous trigger signal independently of the timing data for intermittently triggering the driver module so as to avoid concentration of the work load of the central processing unit.

The present invention is constituted as described above, whereby the music event data of the MIDI format received is stored temporarily. The music event data stored in the buffer is designed to be processed asynchronously by the sound source driver in disperse manner along the time axis, thereby the control parameter responsive to the music event data being generated in advance. Therefore, even though the events occur simultaneously, the sound source driver processing is executed in disperse manner along the time axis, whereby the work load of the CPU cannot be increased suddenly. Therefore, the decrease of the number of music tones due to concentration of temporary processing can be prevented. Particularly, the stable computation ability is required for the generation of the music tone waveform by the software sound source. The sound source driver process consumes only occasionally or intermittently the computation power. The computation power will be only several percents of the total amount if averaged in a long time range. Thus, the distributive execution of the sound source driver processing is quite effective to stabilize the computation ability of the processor. In addition, the sound source driver processing is designed to be executed in advance, and the music tone waveform generation is designed to be executed at the moment of the tone generation timing. Therefore, for the music tone been generated, the processing of the pan control and the tone volume control can be performed in real time a part by part basis.

What is claimed is:

1. A method of generating a music tone by means of a sound source, comprising:

a first step of writing a sequence of event data together with timing data in a first memory section, each event data indicating a music event of a music tone, and each timing data indicating an occurrence timing of each music event;

a second step of retrieving each event data from the first memory section to create control parameters for use in control of the sound source to produce a waveform of the music tone, and storing the control parameters together with the corresponding timing data in a second memory section;

a third step of operating the sound source based on the control parameters and the timing data stored in the second memory section to effect production of the waveform of the music tone, and storing the waveform in a third memory section;

a fourth step of sequentially retrieving the waveform from the third memory section to reproduce the music tone of each music event;

a fifth step of regulating a first timing along with progression of the reproduction of the music tone to trigger the third step at the first timing such that the production of the waveform is regulated along with the occurrence timing of each music event; and a sixth step of regulating a second timing independently of the occurrence timing of the music event to trigger the second step at the second timing such that the creation of the control parameters is regulated separately from the occurrence timing of each music event.

2. The method as claimed in claim 1, utilizing a processor to carry out the generation of the music tone based on the event data and the timing data, wherein the sixth step checks a work load of the processor to issue the second timing when the work load is relatively light and otherwise to suspend issuance of the second timing when the work load is relatively heavy.

3. The method as claimed in claim 1, utilizing a processor to carry out the generation of the music tone based on the event data and the timing data, wherein the sixth step issues the second timing every time the processor counts a predetermined interval by means of a software timer.

4. The method as claimed in claim 1, wherein the second step creates a complete set of control parameters necessary for generating a music tone of one music event each time the second step is triggered in response to the second timing.

5. The method as claimed in claim 1, wherein the second step creates a complete set of control parameters necessary for generating a music tone of one music event after the second step is triggered repeatedly in response to a sequence of the second timings.

6. The method as claimed in claim 1, further comprising a step of detecting if event data remains in the first memory section before the third step is triggered to produce the waveform of the music tone corresponding to the remaining event data for triggering the second step to create the control parameters of the remaining event data so as to enable the sound source to produce the waveform according to the control parameters derived from the remaining event data.

7. The method as claimed in claim 1, further comprising a step of rewriting the control parameters stored in the second memory section before the control parameters are used by the sound source when the music event is altered after the control parameters corresponding to the music event are created and stored in the second memory section.

8. An electronic musical apparatus utilizing a central processing unit for working various modules to generate music tones, while controlling a work load of the central processing unit, the apparatus comprising:

a player module that provides a sequence of event data indicating an event of a music tone and timing data indicating an occurrence time of the event;

a driver module that is intermittently triggered to process the event data to create control parameters reserved for use in generation of the music tone corresponding to the event data;

a sound source module that is routinely triggered to load therein the reserved control parameters for generating the music tone according to the timing data; and a timing module that issues a synchronous trigger signal effective to routinely trigger the sound source module, and that issues an asynchronous trigger signal independently of the timing data for intermittently triggering the driver module so as to avoid concentration of the work load of the central processing unit.

9. The electronic musical apparatus as claimed in claim 8, wherein the timing module checks the work load of the central processing unit so as to issue the asynchronous trigger signal when the work load is relatively light and otherwise to suspend the asynchronous trigger signal when the work load is relatively heavy.

10. The electronic musical apparatus as claimed in claim 8, wherein the timing module issues the asynchronous trigger signal every time the central processing unit counts a predetermined interval.

11. The electronic musical apparatus as claimed in claim 8, wherein the driver module creates a complete set of control parameters necessary for generating a music tone of one event each time the driver module is triggered in response to the asynchronous trigger signal.

12. The electronic musical apparatus as claimed in claim 8, wherein the driver module creates a complete set of control parameters necessary for generating a music tone of one event after the driver module is repeatedly triggered in response to a sequence of the asynchronous trigger signal.

13. The electronic musical apparatus as claimed in claim 8, further comprising a detector module that detects if event data remains unprocessed by the driver module until the sound source module is triggered to generate the music tone corresponding to the remaining event data for causing the timing module to trigger the driver module to create the control parameters of the remaining event data so as to enable the sound source module to generate the music tone according to the control parameters.

14. The electronic musical apparatus as claimed in claim 8, further comprising a module that rewrites control parameters of an event before the control parameters are used by the sound source module when the event is altered after the control parameters are created by the driver module.

15. An apparatus for generating a music tone by means of a sound source and buffer memories, comprising:

first means for writing a sequence of event data together with timing data in a first buffer memory, each event data indicating a music event of a music tone, and each timing data indicating an occurrence timing of each music event;

second means for retrieving each event data from the first buffer memory to create control parameters for use in control of the sound source to produce a waveform of the music tone, and storing the control parameters together with the corresponding timing data in a second buffer memory;

third means for operating the sound source based on the control parameters and the timing data stored in the second buffer memory to effect production of the waveform of the music tone, and storing the waveform in a third buffer memory;

fourth means for sequentially retrieving the waveform from the third buffer memory to reproduce the music tone of each music event;

fifth means for regulating a first timing along with progression of the reproduction of the music tone to trigger the third means at the first timing such that the production of the waveform is regulated along with the occurrence timing of each music event; and sixth means for regulating a second timing independently of the occurrence timing of the music event to trigger the second means at the second timing such that the creation of the control parameters is regulated separately from the occurrence timing of each music event.

16. The apparatus as claimed in claim 15, utilizing a processor to carry out the generation of the music tone based on the event data and the timing data, wherein the sixth means checks a work load of the processor to issue the second timing when the work load is relatively light and otherwise to suspend issuance of the second timing when the work load is relatively heavy.

17. The apparatus as claimed in claim 15, utilizing a processor to carry out the generation of the music tone based on the event data and the timing data, wherein the sixth means issues the second timing every time the processor counts a predetermined interval by means of a software timer.

18. The apparatus as claimed in claim 15, further comprising means to detect if event data remains in the first buffer memory until the third means is triggered to produce the waveform of the music tone corresponding to the remaining event data for triggering the second means to create the control parameters of the remaining event data so as to enable the sound source to produce the waveform according to the control parameters derived from the remaining event data.

19. The apparatus as claimed in claim 15, further comprising means for rewriting the control parameters stored in the second buffer memory before the control parameters are used by the sound source when the music event is altered after the control parameters corresponding to the music event are created and stored in the second buffer memory.

20. A machine readable medium used in an electronic musical apparatus having a central processing unit for operating various modules to generate music tones while controlling a work load of the central processing unit, the medium containing program instructions executable by the central processing unit for causing the electronic music apparatus to perform the method comprising the steps of:

operating a player module that provides a sequence of event data indicating an event of a music tone and timing data indicating an occurrence time of the event;

operating a driver module that is intermittently triggered to process the event data to create control parameters reserved for use in generation of the music tone corresponding to the event data;

operating a sound source module that is routinely triggered to load therein the reserved control parameters for generating the music tone according to the timing data; and operating a timing module that issues a synchronous trigger signal effective to routinely trigger the sound source module, and that issues an asynchronous trigger signal independently of the timing data for intermittently triggering the driver module so as to avoid concentration of the work load of the central processing unit.

21. The machine readable medium as claimed in claim 20, wherein the timing module is operated to check the work load of the central processing unit so as to issue the asynchronous trigger signal when the work load is relatively light and otherwise to suspend the asynchronous trigger signal when the work load is relatively heavy.

22. The machine readable medium as claimed in claim 20, wherein the timing module is operated to issue the asynchronous trigger signal every time central processing unit counts a predetermined interval.

* * * * *